US009284655B2

(12) United States Patent
Kuhn et al.

(10) Patent No.: US 9,284,655 B2
(45) Date of Patent: Mar. 15, 2016

(54) METHOD OF PRODUCING A STEEL COMPONENT PROVIDED WITH A METALLIC COATING GIVING PROTECTION AGAINST CORROSION

(75) Inventors: Patrick Kuhn, Dortmund (DE); Manfred Meurer, Rheinberg (DE); Jens Kondratiuk, Buchs SG (CH); Wilhelm Warnecke, Hamminkeln (DE); Werner Schuler, Issenburg (DE)

(73) Assignee: ThyssenKrupp Steel Europe AG, Duisburg (DE)

( * ) Notice: Subject to any disclaimer, the term of this patent is extended or adjusted under 35 U.S.C. 154(b) by 700 days.

(21) Appl. No.: 13/266,941

(22) PCT Filed: Feb. 24, 2010

(86) PCT No.: PCT/EP2010/052326
§ 371 (c)(1),
(2), (4) Date: Mar. 15, 2012

(87) PCT Pub. No.: WO2011/023418
PCT Pub. Date: Mar. 3, 2011

(65) Prior Publication Data

US 2012/0164472 A1 Jun. 28, 2012

(30) Foreign Application Priority Data

Aug. 25, 2009 (EP) ..... 09168605

(51) Int. Cl.

| | |
|---|---|
| ***C21D 8/00*** | (2006.01) |
| ***C25D 3/56*** | (2006.01) |
| ***C21D 1/18*** | (2006.01) |
| ***C25D 5/48*** | (2006.01) |
| ***C25D 5/50*** | (2006.01) |

(52) U.S. Cl.
CPC *C25D 3/565* (2013.01); *C21D 1/18* (2013.01); *C25D 5/48* (2013.01); *C25D 5/50* (2013.01); *Y10T 428/12535* (2015.01); *Y10T 428/12958* (2015.01)

(58) Field of Classification Search
None
See application file for complete search history.

(56) References Cited

U.S. PATENT DOCUMENTS

| | | | |
|---|---|---|---|
| 2,315,740 | A | 4/1943 | Schoonmaker, Jr. et al. |
| 6,564,604 | B2 | 5/2003 | Kefferstein et al. |

(Continued)

FOREIGN PATENT DOCUMENTS

| | | | |
|---|---|---|---|
| CN | 101358366 | A | 2/2009 |
| DE | 3209559 | A1 | 9/1982 |

(Continued)

OTHER PUBLICATIONS

Machine English translation of Japanese patent No. 2003-073774, Imai Kazuhito et al., Mar. 12, 2003.*

(Continued)

*Primary Examiner* — Deborah Yee
(74) *Attorney, Agent, or Firm* — The Webb Law Firm

(57) ABSTRACT

A method by which a steel component can be produced, which is provided with a metallic coating which adheres well and which provides protection against corrosion, from a flat steel product produced from a steel material containing 0.3-3 wt.-% manganese and having a yield point of 150-1100 MPa and a tensile strength of 300-1200 MPa coated with an anti-corrosion coating which comprises a coating of ZnNi alloy which is electrolytically deposited on the flat steel product, which coating is composed in a single phase of γ-ZnNi phase and which contains, as well as zinc and unavoidable impurities, 7-15 wt.-% nickel.

15 Claims, 5 Drawing Sheets

(56) References Cited

U.S. PATENT DOCUMENTS

| | | | | |
|---|---|---|---|---|
| 7,399,535 | B2 * | 7/2008 | Yoshikawa et al. | 428/659 |
| 2007/0000117 | A1 * | 1/2007 | Brandstatter et al. | 29/527.2 |
| 2007/0256808 | A1 * | 11/2007 | Fleischanderl et al. | 164/72 |
| 2009/0098295 | A1 * | 4/2009 | Riemer et al. | 427/295 |
| 2011/0045316 | A1 | 2/2011 | Brandstatter et al. | |

FOREIGN PATENT DOCUMENTS

| | | | |
|---|---|---|---|
| DE | 102007019196 | A1 | 10/2008 |
| EP | 1143029 | A1 | 10/2001 |
| EP | 1630244 | A1 | 3/2006 |
| WO | 2005021822 | A1 | 3/2005 |
| WO | 2006045570 | A1 | 5/2006 |

OTHER PUBLICATIONS

English abstract of Japanese patent 361194195A, Kurimoto, Mikio et al., Aug. 28, 1986.*

English abstract of Japanese patent 58009965 A, Himeno et al., Jan. 20, 1983.*

* cited by examiner

METHOD OF PRODUCING A STEEL COMPONENT PROVIDED WITH A METALLIC COATING GIVING PROTECTION AGAINST CORROSION

BACKGROUND OF THE INVENTION

1. Field of the Invention

The invention relates to a method of producing a steel component provided with a metallic coating giving protection against corrosion, by the forming of a flat steel product composed of an Mn-containing steel which is provided with a coating of ZnNi alloy before the forming of the steel component.

2. Description of Related Art

When in the present case "flat steel products" are mentioned, what are meant by this term are steel strips, steel sheets, steel plates, or blanks and the like obtained therefrom.

To give the combination of low weight, maximum strength and a protective action which is called for in the construction of modern-day vehicle bodywork, what are currently used in areas of the bodywork which may be exposed to particularly high stresses in the event of a crash are components which are formed from high-strength steels by hot pressing.

In hot press hardening, steel blanks which are taken from hot or cold rolled steel strip are heated to a forming temperature which is generally above the austenitising temperature of the given steel and when in the heated state are placed in the die of a forming press. In the course of the forming which is then carried out, the blank of sheet or plate material, or rather the component formed therefrom, undergoes swift cooling as a result of the contact with the cool die. The cooling rates are set in this case in such a way that a hardened microstructure results in the component.

A typical example of a steel which is suitable for hot press hardening is the one known by the designation "22MnB5" which can be found in the Steel Key (Stahlschlüssel) for 2004 under the material number (Werkstoffnummer) 1.5528.

In practice, the advantages of the known MnB steels which are particularly suitable for hot press hardening are offset by the disadvantage that manganese-containing steels are generally not resistant to wet corrosion and are difficult to passivate. The corrosion concerned, though only local, is heavy, and the tendency for it to occur when exposed to elevated concentrations of chloride ions is high in comparison with less highly alloyed steels and this tendency makes it difficult for steels belonging to the category of materials known as high-alloy sheet steels to be used in the very field of vehicle bodywork construction. Manganese-containing steels also have a tendency to area corrosion, which is likewise a factor which restricts the range of uses which can be made of them.

The search is therefore going on for possible ways of providing manganese-containing steels too with a metallic coating which will protect the steels against corrosive attack.

In the method of producing components by hot press hardening which is described in EP 1 143 029 B1, a steel sheet or plate is first to be provided for this purpose with a zinc coating and then, before being hot formed, is to be heated in such a way that, in the course of the heating, an intermetallic compound comes into being on the flat steel product as a result of a transformation of the coating on the steel sheet or plate. This intermetallic compound is intended to protect the steel sheet or plate against corrosion and decarburizing and to perform a lubricating function during the hot forming in the pressing die.

A wide variety of problems have become apparent when attempts have been made to implement in practice the procedure which is proposed in a general form in EP 1 143 029 B1. In this way, it has proved to be difficult for the zinc coating to be applied to the steel substrate in such a way that, once the intermetallic compound has formed, it can be guaranteed that the coating will adhere sufficiently well to the steel substrate, that the coating will have adequate coatability for a paint finish to be applied subsequently and that both the coating itself and the steel substrate too will have adequate resistance to the formation of cracks in the course of the hot forming.

A proposal as to how zinc coatings to which an organic coating can be applied particularly well can be produced on steel strips is described in EP 1 630 244 A1. Under this proposal, a layer of Zn containing up to 20 wt.-% Fe is applied to the steel sheet or plate to be processed either electrolytically or by the use of some other known coating process. The steel sheet or plate which has been coated in this way is then heated from ambient temperature to 850-950° C. and is formed by hot pressing at 700-950° C. What is mentioned as particularly suitable for the production of the layer of Zn in this case is electrolytic deposition. In this known method, the layer of Zn may also take the form of a layer of alloy. What are cited in EP 1 630 244 A1 as possible alloy constituents for this layer are Mn, Ni, Cr, Co, Mg, Sn and Pb and Be, B, Si, P, S, Ti, V, W, Mo, Sb, Cd, Nb, Cu and Sr are also mentioned as additional alloy constituents.

Something that is essential to the method described in EP 1 630 244 A1 is that the 1-50 μm thick Zn coating which is present on it comprises an iron-zinc solid solution phase and has a layer of zinc oxide whose thickness is restricted, on average, to not more than 2 μm. What is done for this purpose in the known method is either that the annealing condition at the time of the heating to the temperature required for the forming by hot pressing is selected to be such as to produce, at least, a controlled formation of the oxide, or that, after the hot forming, the layer of oxide present on the steel component obtained is at least partly removed by a machining or particle-lifting process sufficiently for the oxide layer to be kept to the maximum thickness given in EP 1 630 244 A1. Hence, this known procedure too calls for costly and complicated measures on the one hand to ensure that the Zn coating will have the desired anti-corrosive effect and on the other hand to ensure that the good coatability and adhesion for paint which are required will exist in a painting operation which takes place after the hot forming.

Known from DE 32 09 559 A1 is a further method by which a coating of zinc-nickel alloy is deposited electrolytically on strip steel. In the course of this method, the strip to be coated is subjected, before the ZnNi coating is deposited, to intensive non-electrical pre-treatment to produce on it a thin primary layer containing zinc and nickel. Following this the actual zinc-nickel coating is then applied electrolytically. So that the electrolytic deposition of the alloy coating is constantly performed with a preset composition, separate anodes are used which each contain only one alloying element. These anodes are connected to separate circuits to enable the current flowing through them, and hence the release of the given metal into the electrolyte, to be set in a targeted way.

The results of a systematic examination of the properties of zinc alloy coatings on a steel sheet which was composed of a hardenable steel are given in WO 2005/021822 A1. The coating was composed in this case essentially of zinc and contained in addition one or more elements with an affinity for oxygen in a total quantity of 0.1 to 15 wt.-% as a percentage of the coating as a whole. What are actually cited in this case as elements with an affinity for oxygen are Mg, Al, Ti, Si, Ca, B and Mn. The steel sheet which had been coated in this way was then raised to a temperature required for hardening while atmospheric oxygen was admitted. In the course of this heat treatment, a surface layer of oxide of the element or elements with an affinity for oxygen was formed.

In one of the trials which are described in WO 2005/021822 A1, a ZnNi coating was produced by the electrolytic deposition of zinc and nickel on a metal sheet of unspecified composition. The ratio by weight of zinc to nickel in the anti-corrosion layer was approximately 90:10 for a layer thickness of 5 μm. The sheet which had been coated in this way was annealed for 270 s at 900° C. in the presence of atmospheric oxygen. This produced, as a result of diffusion of the steel into the layer of zinc, a thin diffusion layer composed of zinc, nickel and iron. At the same time, the bulk of the zinc oxidised into zinc oxide.

From the findings which are documented in WO 2005/021822 A1 it is evident that the ZnNi coating obtained in the above way provided pure barrier protection and did not have any cathodic anti-corrosion effect. Its surface was of a scaled, green appearance with small local areas of peeling where the layer of oxide did not adhere to the steel. According to WO 2005/021822, the reason for this was that the coating itself did not contain an element with a sufficiently high affinity for oxygen.

SUMMARY OF THE INVENTION

Against this background, the object underlying the invention was to specify a method which was easy to carry out in practice and which, with comparably little cost and complication, would allow a steel component to be produced which was provided with a metallic coating which adhered well and gave reliable protection against corrosion. As well as this, the intention was also to specify a steel component obtained in a corresponding manner.

The first variant of the method according to the invention comprises forming the steel component by what is called the "direct" method, whereas the second variant of the method embraces the forming of the steel component by what is called the "indirect" method.

Advantageous embodiments of the variants of the method according to the invention are specified in the claims.

With regard to the steel component, the way in which the above-mentioned object is achieved in accordance with the invention is that a component of this kind has the features which are specified in Claim 14. Advantageous variants of the steel component according to the invention are specified in the claims which are referred back to Claim 14 and will be explained below.

In the method according to the invention of producing a steel component which is provided with a metallic coating which gives protection against corrosion, a flat steel product, i.e. a steel strip, steel sheet or sheet plate, is first made available which is produced from a hardenable steel material of quite high strength which contains 0.3-3 wt.-% manganese. This steel material has a yield point of 150-1100 MPa and a tensile strength of 300-1200 MPa.

The steel material may typically be a high-strength MnB steel of a composition which is known per se. Hence, the steel which is processed in accordance with the invention may contain iron and unavoidable impurities as well as (in wt.-%) 0.2-0.5% C, 0.5-3.0% Mn, 0.002-0.004% B and, as an option, one or more elements from the group comprising Si, Cr, Al, Ti, in the following quantities: 0.1-0.3% Si, 0.1-0.5% Cr, 0.02-0.05% Al, 0.025-0.04% Ti.

The method according to the invention is suitable for producing steel components both from hot rolled strip, sheet or plate which is only hot rolled in the conventional way, and from steel strip, sheet or plate which is cold rolled in the conventional way.

The flat steel product which is obtained and made available in this way is coated with an anti-corrosion coating, this coating comprising, in accordance with the invention, a zinc-nickel alloy coating, comprising a single γ-ZnNi phase, which is applied to the steel substrate electrolytically. This coating of ZnNi alloy may itself form the anti-corrosion coating on its own or may be supplemented by further protective layers which are applied to it.

The γ-zinc-nickel phase of the coating of ZnNi alloy lying on the steel substrate has already been produced by the electrolytic coating. What this means is that, in contrast to coating processes in which an alloy layer only forms as a result of the heating to the temperature required for the subsequent hot forming and hardening and as a result of the diffusion processes which are thus set in train, in the procedure according to the invention an alloy layer of a given composition and structure which is composed of zinc and nickel is already present on the flat steel product even before the heating. The proportions of Zn and Ni and the deposition conditions during the production of the layer of ZnNi alloy are selected in such a way in this case that the layer of ZnNi alloy takes the form of a single phase coating, composed of Ni5Zn21 phase, which has a cubic lattice structure. To consider is that, when deposited from an electrolyte, this layer of γ-ZnNi phase does not come into being at the stoichiometric composition but at nickel contents which are in the range of 7-15%, particularly good properties being obtained for the coating at nickel contents of up to 13 wt.-%, and in particular of 9-11 wt.-%.

What are grouped together under the above-mentioned "deposition conditions" are for example the nature of the incident flow on the substrate being coated, the speed of flow of the electrolyte, the Ni:Zn ratio in the electrolyte, the orientation of the electrolyte flow relative to the steel substrate being coated in the given case, the current density, and the temperature and pH-value of the electrolyte. In accordance with the invention, these influencing factors have to be matched to one another in such a way that the single-phase ZnNi coating which is being aimed for comes into being with the Ni contents which are preset in accordance with the invention. For this purpose, the parameters mentioned may each be varied as follows as a function of the systems engineering available in the given case:

- Nature of the flow against the substrate being coated: laminar or turbulent; good results are obtained from the coating process both when the flow of the electrolyte against the flat steel product being coated is laminar and when it is turbulent. However, in many of the coating plants which are available in practice turbulent flow is preferred because of the more vigorous exchange between the electrolyte and the steel substrate.
- Speed of flow of the electrolyte: 0.1-6 m/s;
- Ni:Zn ratio in the electrolyte: 0.4-4;
- Orientation of the electrolyte flow relative to the steel substrate being coated in the given case: the coating of the steel substrate may take place both in vertically orientated cells and in horizontally orientated cells;
- Current density: 10-140 A/dm$^2$;
- Temperature of the electrolyte: 30-70° C.;
- pH of the electrolyte: 1-3.5;

A particular advantage of the coating, performed electrolytically in accordance with the invention, of the flat steel product with a layer of ZnNi alloy of exactly preset composition and structure also lies in the fact that the coating thereby produced has a matt, rough surface whose reflectivity is less than that of the typical Zn coatings which are produced in the course of known methods of hot press forming. Consequently, flat steel products which have been coated in a manner according to the invention have an increased capacity for absorbing heat, and the subsequent heating to the given blank or component temperature can thus be performed faster and with less expenditure of energy. The shorter dwell times in ovens and the savings on energy which are made possible in this way make the method according to the invention particularly economical.

From the flat steel product which has been coated in a manner according to the invention, a steel blank is then formed. This can be taken from the given steel strip, steel plate or steel sheet in a manner which is known per se. It is however also conceivable for the flat steel product to already be of the form required for the subsequent forming into the component at the time of the coating, i.e. for it to correspond to the blank.

The steel blank which has thus been provided with a coating of single-phase ZnNi alloy in a manner according to the invention is then heated, in the first variant of the method according to the invention, to a blank temperature of not less than 800° C. and the steel component is then formed from the blank which has been heated. In the second variant of the method on the other hand, the steel component is at least pre-formed from the blank and only after this is the heating to the component temperature of at least 800° C. performed.

In the course of the heating to the blank or component temperature of at least 800° C., a partial substitution of atoms begins in the ZnNi alloy layer applied to the steel substrate even at temperatures of less than 700° C., in which the intermetallic γ-zinc-nickel phase (Ni5Zn21) rearranges itself into a Γ-zinc-iron-phase (Fe3Zn10). Above approx. 750° C. as the heating progresses further an α-ferrite-mixed crystal then forms in which Zn and Ni are present in solution. This process continues until the steel substrate is heated to the respective blank or component temperature of at least 800° C. and a two-phase coating composed of an α-Fe mixed crystal, in which Zn and Ni are present in solution and a mixed gamma phase $Zn_xNi(Fe)_y$ in which Ni-atoms are replaced by Fe-atoms and vice versa, is present on the steel substrate. Accordingly a pure alloy layer is no longer present on the component produced in the inventive way but instead a two-phase coating, by far the predominant part of which is composed of α-Fe(Zn,Ni) mixed crystal and in which intermetallic compounds of Zn, Ni and Fe are present at the most to a minimised extent. By contrast with the prior art, wherein firstly a zinc coating is applied to the steel substrate and wherein, in the course of the heating before hot-forming, an intermetallic compound comes into being as the result of a transformation of the coating on the steel sheet, one starts in the case of the inventive method from the very beginning with an alloy coating, electrolytically deposited on the steel substrate and consisting of an intermetallic compound produced in a controlled way, by far the greatest part of which converts into mixed crystal in the annealing process carried out for shaping or hardening.

Such a coating is present on the finished product, at least 70 mass-%, in particular at least 75%, and typically up to 95 mass-%, in particular 75-90%, of which consists of mixed crystal and the remainder of intermetallic phase. Dependent on the annealing conditions and the thickness of the respective coating, these are distributed between the mixed crystals as dispersed low volume concentrations or lie on the mixed crystal. Hence the original alloy coating in the phase diagram palpably changes from the Zn-rich corner into the Fe-rich corner. Accordingly an iron-zinc alloy is present on the finished steel component. That is to say a coating, which is no longer zinc-based but consists of an iron-based alloy, is obtained with the inventive method.

In the first variant of the method according to the invention, the blank which has been heated in accordance with the invention to a temperature of at least 800° C. is formed into the steel component. This may for example be done by feeding the blank to the forming die which is used in the given case immediately following the heating. On the way to the forming die, it is generally inevitable for a cooling of the blank to occur, which means that in the event of a hot-forming operation of this kind following the heating, the temperature of the blank when it enters the forming die is usually less than the blank temperature on leaving the oven. In the forming die, the steel blank is formed into the steel component in a manner known per se.

If the forming is carried out at temperatures sufficiently high for hardened or tempered microstructures to form, then the steel component obtained can be cooled, starting from the given temperature, at a rate of cooling sufficient for tempered or hardened microstructures to come into being in its steel substrate. It is particularly economical for this process to take place in the forming die itself.

Because of the insensitivity of the flat steel product which has been coated in a manner according to the invention to cracks in the steel substrate and to abrasion, the method according to the invention is thus particularly suitable for single-stage hot press forming in which hot forming of the steel component and the cooling thereof, using the heat from the heating operation to the blank temperature carried out previously, are carried out in a single operation in a single die.

In the second variant of the method, the blank is formed first and then the steel component is formed from this blank without any intervening heating. The forming of the steel component is typically performed in this case by a cold forming process in which one or more cold forming operations are performed. The degree of cold forming may be sufficiently high in this case for the steel component obtained to be formed to a substantially fully finished state. However, it is also conceivable for the first forming operation to be performed as a pre-forming operation and for the steel component to be formed to the finished state in a forming die after the heating. This finish forming may be combined with the hardening process by performing the hardening as press hardening in a suitable forming die. In this case, the steel component is placed in a die which images its final finished shape and is cooled sufficiently fast for the desired hardened or tempered microstructure to form. Hence the press hardening makes it possible for the steel component to maintain its shape particularly well. The change of shape during the press hardening is usually small in this case.

Regardless of which of the two variants of the method according to the invention is used, the forming does not have to be carried out in some special way which differs from the prior art, and neither does the cooling which is required for the creation of the hardened or tempered microstructure. Instead, known methods and existing apparatus can be used for this purpose. Because an alloy coating has already been produced, in a manner according to the invention, on the blank which is to be formed, there is no risk in the event of hot forming or forming at elevated temperatures that there will be any softening of the coating and hence any sticking of coating material to the surfaces of the die which come into contact with it.

The 0.3-3 wt.-%, and in particular 0.5-3 wt.-% Mn content of the steel substrate which is processed in accordance with the invention acquires a particular significance in combination with the coating, consisting of α-Fe(Zn,Ni) mixed crystal and a subordinated proportion of intermetallic compounds, which is produced in accordance with the invention on the flat steel product. In this way, the Mn which is present in the steel substrate in the case of the steel component which is produced in accordance with the invention makes a substantial contribution to the good adhesion of the coating.

Before the heating to the blank or component temperature, the anti-corrosion coating which is applied in accordance with the invention contains in each case less than 0.1 wt.-% manganese. In the subsequent heating to the plate or component temperature, a diffusion of the manganese present in the steel substrate then begins towards the free surface of anti-corrosion coating which has been applied in accordance with the invention.

The Mn atoms which diffuse into the layer of ZnNi alloy in the course of the heating cause on the one hand a strong linkage of the coating to the steel substrate.

On the other hand a substantial proportion of the Mn makes its way to the surface of the anti-corrosion coating which is produced in accordance with the invention and builds up there in a metallic or oxidic form. The thickness of the Mn-containing layer which is present in this way on the coating which has been produced in accordance with the invention—which Mn-containing layer will, for simplicity's sake, be referred to below simply as the "layer of Mn oxide"—is typically 0.1 to 5 μm. The positive effects of the layer of Mn oxide become apparent in this case in a particularly reliable way if its thickness is at least 0.2 μm, and in particular at least 0.5 μm. In this Mn-containing layer close to the surface, which borders on the surface, the Mn content of the anti-corrosion coating is 1-18 wt.-% and in particular 4-7 wt.-%.

As well as the linkage described above to the steel substrate, what the pronounced layer of Mn oxide which is present on the coating which is produced in a manner according to the invention also ensures is particular good adhesion for organic coatings which are applied to the anti-corrosion coating. The procedure according to the invention is therefore particularly suitable for producing parts for vehicle bodywork which, having been formed, are provided with a paint finish.

In contrast to the prior art which was elucidated in the introduction, it is not absolutely necessary for the pronounced layer of oxide which is obtained in accordance with the invention to be removed. Instead provision is made, in an embodiment of the variants of the method according to the invention which is right for practical requirements, for the layer of oxide which is obtained by a procedure according to the invention to be deliberately left in place on the anti-corrosion coating because this layer of oxide not only ensures particularly good coatability for steel components produced and obtained in accordance with the invention but, what is more, due to its comparatively high conductivity, also ensures for them a weldability which is, as a whole, good.

When steels having an Mn content of less than 0.3 wt.-% by weight are used, the result is a coating of a yellowish appearance, which indicates that a layer of oxide composed principally of ZnO is present on the coating. In a similar way to what happened in the trial reported on in WO 2005/012822, the coating which is produced in this way shows local peelings and flakings after the hot forming. A coating which is produced in accordance with the invention on a steel containing at least 0.3 wt.-% Mn on the other hand has a brownish surface which is free of flakings and peelings.

The ZnNi coating which is deposited in accordance with the invention on the flat steel product is applied in practice in a thickness of 0.5-20 μm. A particularly good protective effect on the part of the ZnNi coating which is produced in accordance with the invention is obtained if the coating is deposited on the flat steel product in a thickness of more than 2 μm. Typical thicknesses for a coating produced in accordance with the invention are in the range of 2-20 μm and are in particular 5-10 μm.

More greatly optimised protection against corrosion can be achieved for the steel component which is produced in accordance with the invention by having the anti-corrosion coating comprise, in addition to the coating of ZnNi alloy which is applied to the flat steel product, a layer of Zn which is also applied to the layer of ZnNi before the heating step. What is then present on the flat steel product which has been prepared for further processing into the component according to the invention, before the heating to the given blank or component temperature, is an anti-corrosion coating in at least two layers whose first layer is formed by the layer of ZnNi alloy constituted in a manner according to the invention and whose second layer is formed by the layer of Zn resting thereon, which is composed only of Zn.

The layer of Zn applied in addition, which is typically 2.5-12.5 μm thick, is present on the finished steel component according to the invention as a Zn-rich layer into which Mn and Fe from the steel substrate and Ni from the layer of ZnNi may have been alloyed. In this case, some of the Zn reacts into Zn oxide and forms, with the Mn from the substrate material, the Mn-containing layer which lies on the anti-corrosion coating produced in accordance with the invention. The application of an additional layer of Zn for the anti-corrosion coating before the heating for the hot forming thus results in a further improvement in the cathodic anti-corrosion protection.

It has been found in this case that in the finished hot formed and hardened state, the layer of Mn oxide which was described in detail above is present even when the additional layer of Zn is present on the surface of the anti-corrosion coating. Exactly as in the case of an anti-corrosion coating combined from a layer of ZnNi and a layer of Zn, this layer of Mn oxide ensures good weldability for a steel component which has been produced and obtained in accordance with the invention and also that it is well suited to receiving a paint finish.

The additional layer of Zn for the anti-corrosion coating can be deposited electrolytically just like the ZnNi layer which was applied previously. For this purpose, on for example a multi-stage arrangement for electrolytic coating through which progress takes place in a continuous flow, the coating of ZnNi alloy may be deposited on the given steel substrate in the first stages and the layer of Zn may be deposited on the layer of ZnNi in the stages which are progressed through after this.

As explained above, a steel component according to the invention is produced by hot press forming and has a steel substrate comprising a steel containing 0.3-3 wt.-% manganese, and an anti-corrosion coating applied on the top thereof which comprises a coating layer, at least 70 mass-% of which is composed of α-Fe(Zn,Ni) mixed crystal and the remainder of an intermetallic compound of Zn, Ni and Fe, and which has at its free surface an Mn-containing layer in which the Mn is present in metallic or oxidic form. Dependent on the annealing time, annealing temperature and thickness of the coating layer, the intermetallic compounds in this case are diffused in the α-Fe(Zn,Ni) mixed crystal as low volume speckles.

In addition, the anti-corrosion coating may, in the way which has already been described above, comprise a layer of Zn which lies on the layer of ZnNi, the Mn-containing layer being present on the anti-corrosion coating in this case too.

To ensure an optimum result from the electrolytic coating process, the flat steel product may be subjected, in a manner which is known per se and before the electrolytic coating, to pre-treatment in which the surface of the steel substrate is treated in such a way that this surface is in a state which is prepared in an optimum way for the coating with the anti-corrosion layer which is to take place subsequently. For this purpose, one or more of the steps of pre-treatment listed below may be progressed through:

- Alkaline degreasing of the flat steel product in a degreasing bath. The degreasing bath typically contains 5-150 g/l, and in particular 10-20 g/l, of a surfactant cleaner. The temperature of the degreasing bath is 20-85° C. in this case, with particularly good effectiveness occurring at a bath temperature of 65-75° C. This is particularly true when the degreasing is performed electrolytically, particularly good results being achieved from the cleaning in this case if at least one cycle takes place in which the specimen is of anodic and cathodic polarity. In the alkaline cleaning, it may prove to be advantageous in this case not only for electrolytic dip degreasing to take place but also for spray/brush cleaning with the alkaline medium to be performed even before the electrolytic cleaning.
- Flushing of the flat steel product, this flushing being performed by means of clean water or de-ionised water.
- Pickling of the flat steel product. In the pickling, the flat steel products are conveyed through an acid bath which strips the oxide layer off them without attacking the surface of the flat steel product itself. The deliberately performed step of pickling controls the removal of oxide in such a way that a surface is obtained which is favourably set up for the electrolytic strip galvanising. After the pickling it may be useful for the flat steel product to be flushed again to remove any residual amounts of the acid used for the pickling from the said flat steel product.
- If flushing of the flat steel product is performed, the flat steel product may be brushed mechanically during it to allow even firmly seated particles to be removed from its surface.
- Any liquids still present on the pre-treated flat steel product are usually removed by means of squeeze rolls before it enters the bath of electrolyte.

The following variants may be cited as good practical examples of pre-treatments which produce particularly good results from the electrolytic coating:

EXAMPLE 1

A box annealed cold-rolled strip is degreased with an alkaline spray and is also degreased electrolytically. The degreasing bath contains, at a concentration of 15 g/l, a commercially available cleaner which can be obtained under the name "Ridoline C72" and which contains more than 25% of sodium hydroxide, 1-5% of a fatty alcohol ether and 5-100 of an ethoxylated, propoxylated and methylated C12-18 alcohol. The bath temperature is 65° C. The dwell time for the spray degreasing is 5 s. This is followed by brush cleaning. As the process continues, the strip is electrolytically degreased for a dwell time of 3 s with anodic and cathodic polarity and at a current density of 15 A/dm$^2$. This is followed by multi-stage flushing with de-ionised water at ambient temperature with brushes being used. The dwell time for the flushing is 3 s. The strip next progresses through pickling with hydrochloric acid (20 g/l; temperature of 35-38° C.) with a dwell time of 11 s. After a flush with de-ionised water lasting for 8 s, the sheet or plate is transferred into the electrolysis cell after passing through a squeeze-roll arrangement. The coating in accordance with the invention of the steel strip, sheet or plate takes place in the electrolysis cell in the way which will be explained in detail below by reference to the embodiments. The flat steel product leaving the electrolytic coating line may be flushed with water and de-ionised water at ambient temperature in a plurality of stages. The total dwell time under the flushing is 17 s. Following this the flat steel product then travels through a drying section.

EXAMPLE 2

Hot-rolled strip (pickled) of 22MnB5 grade (1.5528) is degreased with an alkaline spray and is degreased electrolytically. In addition, the strip undergoes brush cleaning in the course of the degreasing with the alkaline spray. The degreasing bath contains, at a concentration of 20 g/l, a commercially available cleaner which can be obtained under the name "Ridoline 1893" and which contains 5-10% of sodium hydroxide and 10-20% of potassium hydroxide. The bath temperature is 75° C. The dwell time under the spray degreasing is 2 s. As the process continues, the strip is electrolytically degreased for a dwell time of 4 s with anodic and cathodic polarity and at a current density of 15 A/dm$^2$. This is followed by multi-stage flushing with de-ionised water at ambient temperature with brushes being used at an upstream point. The dwell time is 3 s. The strip next progresses through pickling with hydrochloric acid (90 g/l, max. temperature of 40° C.) with a dwell time of 7 s. After five-stage cascade flushing with de-ionised water, the sheet or plate is transferred to the electrolysis cell after passing through a squeeze-roll arrangement, and in the electrolysis cell it is provided with an anti-corrosion coating in a manner according to the invention, as will be described below by reference to the embodiments. On leaving the system for electrolytic coating, the flat steel product, which is now coated in accordance with the invention, is flushed with de-ionised water in three stages at 50° C. Following this the specimen passes through a drying section employing an air-recirculating dryer, the air temperature being more than 100° C.

EXAMPLE 3

Box-annealed cold-rolled strip of 22MnB5 grade (1.5528) is degreased with an alkaline spray and is degreased electrolytically. The degreasing bath contains, at a concentration of 20 g/l, a cleaner which contains 1-5% of C12-18 fatty alcohol polyethylene glycol butyl ether and 0.5-2% of potassium hydroxide. The bath temperature is 75° C. The dwell time for the horizontal spray flushing is 12 s. This is followed by two spells of brush cleaning. As the process continues, the strip is electrolytically degreased for a dwell time of 9 s with anodic and cathodic polarity and at a current density of 10 A/dm$^2$. This is followed by multi-stage flushing with de-ionised water at ambient temperature with brushes being used. The dwell time is 3 s. The strip next progresses through pickling with hydrochloric acid (100 g/l, ambient temperature) with a dwell time of 27 s. After combined flushing with brushes and sprayed fresh water, the sheet or plate is transferred to the electrolysis cell after passing through a squeeze-roll arrangement. In the electrolysis cell, the electrolytic deposition according to the invention of the anti-corrosion coating takes place in the way which will be described below by reference to the embodiments. Following the electrolytic coating the flat steel product, which has thus been coated in a manner according to the invention, is flushed with water and de-ionised water in two stages at 40° C. Total dwell time is 18 s.

Following this the specimen travels through a drying section employing an air-recirculating blower with the recirculated air at a temperature of 75° C.

The process produces optimum results if the temperature of the blank or component is, in a manner known per se, a maximum of 920° C., and in particular 830-905° C. This is particularly true if the forming of the steel component is carried out as hot forming following heating to the blank or component temperature in such a way that a certain loss of temperature is accepted when the heated blank (the "direct" method) or the heated steel component (the "indirect" method) is placed in whatever forming die is then used in the given case. Whatever hot forming takes place as the concluding operation in the given case can be performed with particular reliability when the blank or component temperature is 850-880° C.

The heating to the blank or component temperature can take in a manner known per se in a pass through a continuous-heating oven. Typical annealing times in this case are in the range of 3-15 min, wherein on the one hand an optimally constituted coating layer and on the other hand particularly economic production conditions result if the annealing times lie in the range of 180-300 or annealing is completed as soon as the respective steel substrate, with the coating applied to it, is through-heated. However, it is also possible as an alternative for the heating to be performed by means of an inductively or conductively operating heating means. This allows heating to whatever temperature is preset in the given case to take place in a particular quick and accurate way.

BRIEF DESCRIPTION OF THE DRAWINGS

The invention will be described in what follows by reference to embodiments. In the drawings.

DETAILED DESCRIPTION OF THE INVENTION

Figure 1:
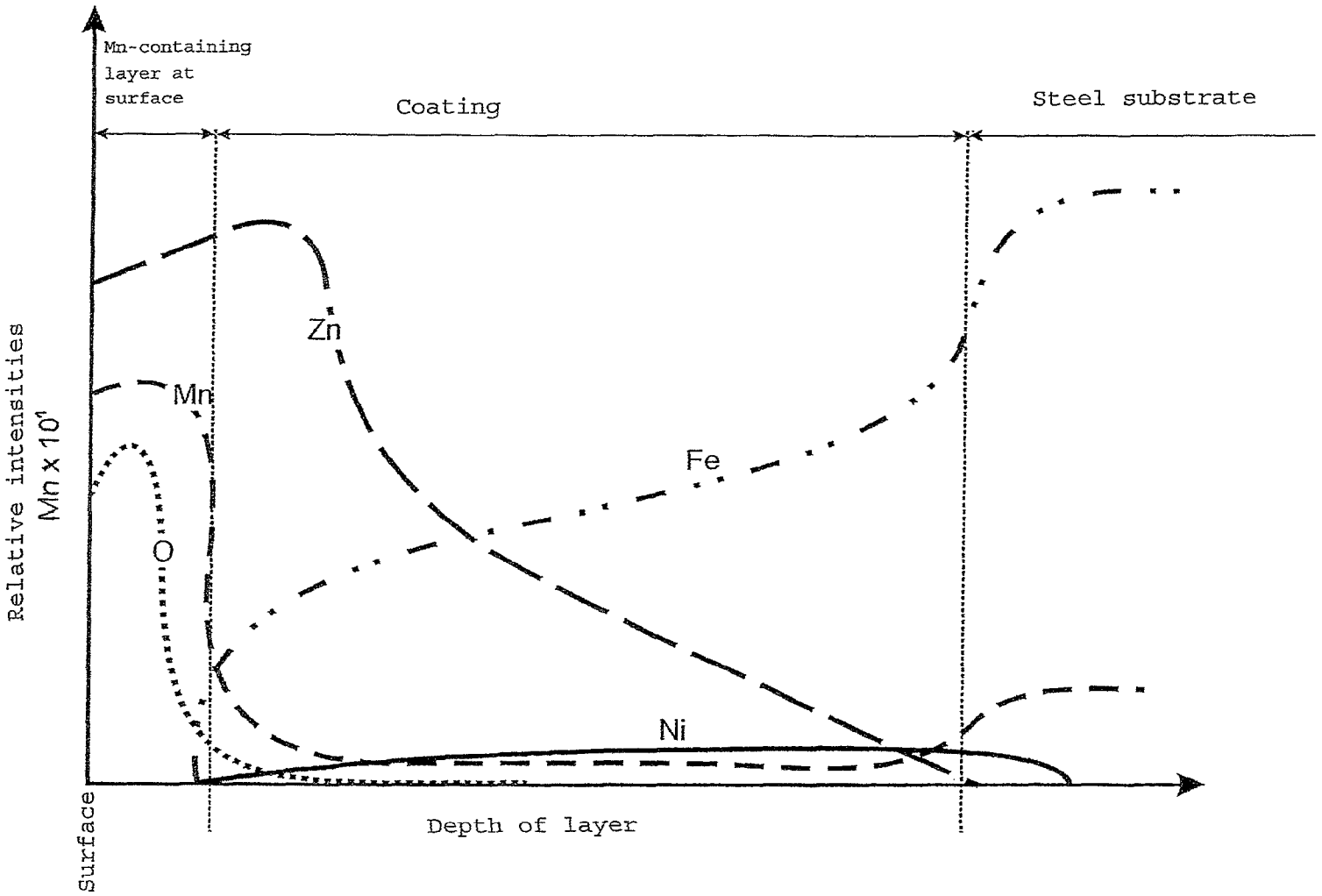
FIG. 1 shows the results of a GDOS measurement of a coating according to the invention after the hot forming, for the elements O, Mn, Zn, Ni and Fe.

Specimens A-Z of cold-rolled, recrystallisation annealed and skin-pass-rolled strip material—referred to below for simplicity's sake simply as "specimens A-V2"—were made available, which had been provided with a layer of zinc-nickel alloy on an electrolytic galvanising line though which they travelled in a continuous pass. A specimen "Z" had also been melt dip coated for comparison.

The Mn contents are of significance in the present case and are given in the "Mn content" column in Table 2 for each of the specimens A-Z, which were composed of a hardenable steel. The Table shows that specimen 8 A-Q and Z each had Mn contents of more than 0.3 wt.-% whereas the Mn contents of specimens V1, V2 were below the limiting level of 0.3 wt.-%.

Each of the specimens A-V2 in strip form first progressed through a cleaning treatment in which it passed through the following operating steps one after the other:

The given specimen A-V2 was first subjected to spray cleaning, with the use of brushes, in an alkaline bath of cleaner at a temperature of 60° C. for a dwell time of 6 s.

Electrolytic degreasing at a current density of 15 A/dm$^2$ then took place for 3 s.

This was followed by flushing twice with clean water, with the use of brushes. The duration of each of these flushing treatments was 3 s.

After this, pickling with hydrochloric acid at a concentration of 150 g/l was carried out at ambient temperature for 8 s.

In conclusion, three-stage cascade flushing with water took place.

The specimens A-V2 which had been pre-treated in this way were subjected to electrolytic coating in an electrolysis cell. The following operating parameters, as respectively set for the specimens A-V2, are given in Table 1: "Zn"=Zn content of the electrolyte in g/l, "Ni"=Ni content of the electrolyte in g/l, "Na2SO4"=Na2SO4 content of the electrolyte in g/l, "pH-value"=pH-value of the electrolyte, "T"=temperature of the electrolyte in ° C., "Cell type"=orientation of the incident flow on the strip produced by the electrolyte, "Speed of flow"=speed of flow of the electrolyte in m/s, and "Current density"=current density in A/dm$^2$.

Specimen Z was hot galvanised in the conventional way as a comparison.

Shown in Table 2 are not, only the Mn contents of the respective specimens A-V2 but also the properties of the ZnNi coatings which were electrolytically deposited under the above conditions. It can be seen that a single-phase γ-ZnNi coating according to the invention was obtained in the case of variants A-H and N-P, whereas in the case of variants I-K η-Zn, i.e. elemental zinc, and γ-ZnNi were present next to one another.

In the case of variants Z and M, before the layer of ZnNi was applied, a thin layer of pure nickel (a so-called "nickel flash") was applied to the steel substrate. What this latter layer involved was deposits of pure nickel which were situated below the coating of single-phase γ-ZnNi. A multi-layered structure of this kind does not have any positive effect on the properties which are to be achieved and because of this these variants have been designated "not according to the invention" in the same way as the specimens obtained under variants I-K.

The Ni content of specimen Q was too high, and this specimen too was therefore considered to be "not according to the invention".

Specimens V1 and V2 were produced from a steel which had a too low Mn content. These specimens too were therefore designated "not according to the invention" even though they had a γ-ZnNi coating according to the invention.

In view of the single-phase structure of their-coating of ZnNi alloy, the electrolytically coated specimens A-H and N-P could be considered "according to the invention" and blanks 1 to 23 were taken from them.

In addition to this, blanks 31-35 were taken from the specimens L and M which had a two-layer ZnNi coating with a nickel flash, a blank 36 was taken from specimen Q, which could likewise not be considered "according to the invention" because of the excessively high Ni content of its coating, and blanks 37 to 40 were taken from the specimens V1 and V2 which were produced for comparison and a blank 41 was taken from the comparison specimen Z.

Blanks 1 to 41 were then heated to the blank temperature "T oven" which is given in Table 3 for an annealing time "t anneal" and were each formed into a steel component in a single stage in a conventional die for hot press hardening and were cooled sufficiently quickly for a hardened microstructure to form in the steel substrate.

For each of the steel components produced from blanks 1 to 41, the behaviour when hot formed which was found in the course of the hot press forming was assessed and checked by seeing whether there had been any cracking in the given steel substrate in the course of the hot press forming. The results of this assessment and checking process are also shown in Table 3.

The steel components formed from blanks 1 to 36 and 41 were then subjected to a salt spray test under DIN EN ISO 9227. Where, in this test, any corrosion of the substrate metal was found after 72 h or 144 h, this is noted in the columns headed "Substrate metal corrosion 72 h" and "Substrate metal corrosion 144 h" in Table 3.

It was found that the steel components which were produced from blanks 9 to 23 which had Ni contents of 9-13 wt.-% in their originally applied coating of ZnNi alloy not only showed optimum behaviour when formed but also had superior resistances to corrosion.

It is true that good behaviour when hot formed was found for the steel component which was formed from the conventionally coated blank 41 obtained from specimen Z. It did not however meet the requirements laid down for avoidance of cracking of its steel substrate.

Peeling of the coating and an inadequate resistance to corrosion on its part were found for the steel components which were produced from the blanks 37-40 taken from comparison specimens V1 and V2. Because this constituted a criterion for exclusion, no further checks were made on these steel components.

The GDOS measurement process (GDOS=glow discharge optical emission spectrometry) is a standard process for the fast detection of a profile of concentrations for coatings. It is described in, for example, the VDI-Lexikon Werkstofftechnik [VDI Lexicon of Materials Science], edited by Hubert Gräfen, VDI-Verlag GmbH, Düsseldorf 1993.

Figure 2:
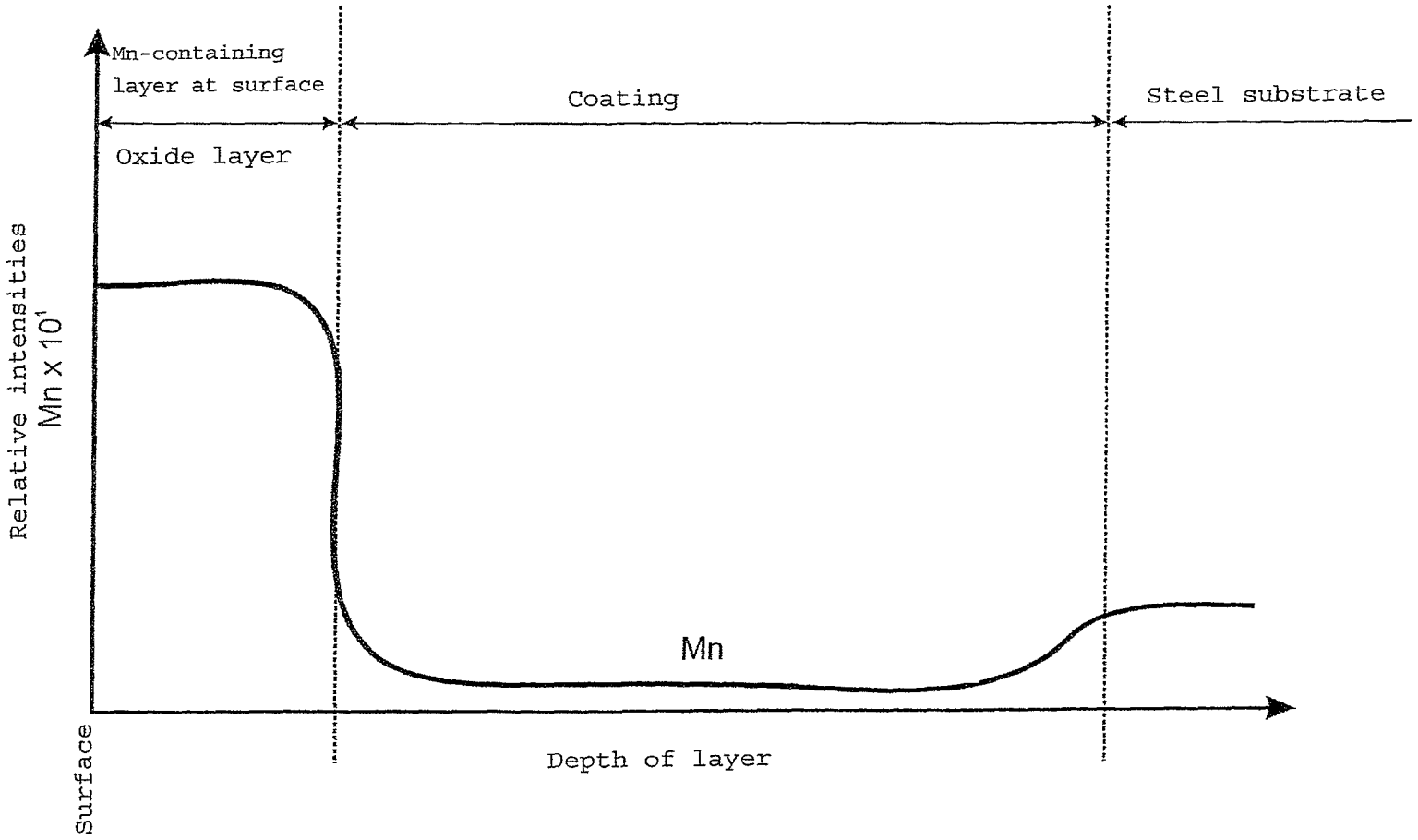
FIG. 2 shows the measured result which is shown in FIG. 1 for the element Mn, in isolation.

Shown in FIG. 1 is a typical result of the GDOS measurement of the anti-corrosion coating of a steel component produced and obtained in a manner according to the invention. In it, the contents of Mn (line of short dashes), O (dotted line), Zn (line of long dashes), Fe (dotted and dashed line) and Ni (solid line) are plotted against the thickness of the coating layer. It can be seen that at the surface of the coating there is a high concentration of Mn which has diffused from the steel substrate through the coating to the surface of the latter and has there oxidised with the ambient oxygen. In the ZnNi-containing layer of the coating on the other hand the Mn content is considerably lower and only rises again when the steel substrate is reached. This can be seen particularly clearly in FIG. 2. The Ni content of the coating on the other hand is substantially constant over its entire thickness.

In a further test, a recrystallised cold-rolled strip was first coated electrolytically with a single-phase coating of ZnNi alloy composed of the γ-ZnNi phase, in the same way as specimens according to the invention which were explained above. The thickness of the layer of γ-ZnNi alloy coating was 7 μm with an Ni content of 10%. A 5 μm thick Zn layer composed of pure zinc was then applied to this coating of ZnNi alloy, likewise electrolytically.

Blanks were taken from the cold-rolled strip provided with a two-layer anti-corrosion coating which was obtained in this way and were heated to a blank temperature of 880° C. within a length of time of 5 minutes. After the hot forming and hardening, an anti-corrosion layer was present on the steel component obtained. There was also a pronounced layer of Mn oxide present at the surface of this layer, below which there was a Zn-rich layer below which in turn was a layer of ZnNi resting on the steel substrate.

Figure 3:
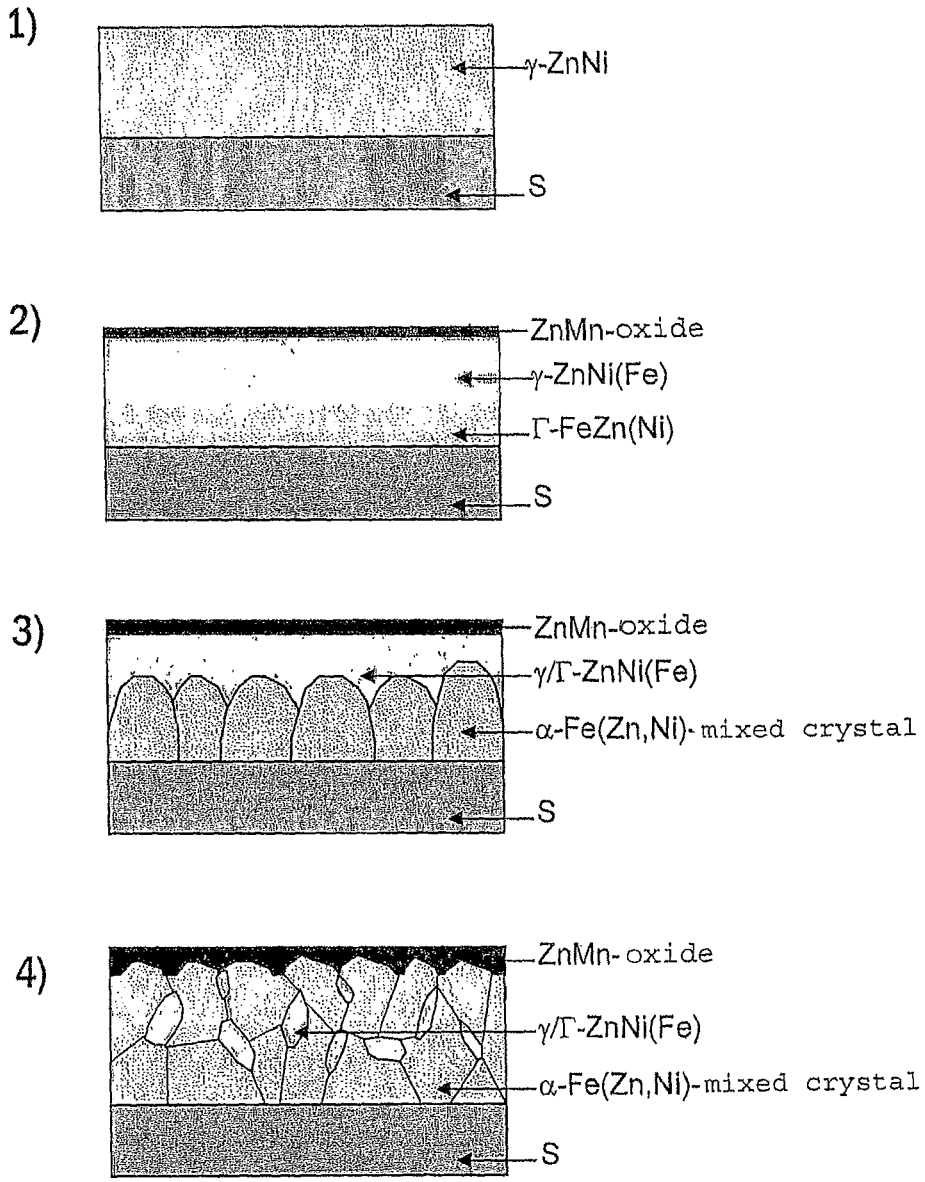
FIG. 3 is a schematic illustration of the structure of a coating at various times of production.

In order to check how the coating applied to the respective blank develops during the heating to the blank temperature and in what way the coating on the finished component obtained is constituted, using specimens provided with a coating of ZnNi alloy in accordance with the inventive method, firstly the structure of the coating is examined after the electrolytic coating, after heating to 750° C. with subsequent cooling and finally on the component which is finish formed and hardened after through-heating to 880° C. The states of the coating at the three moments in time concerned may be described as follows:

a) After Coating (FIG. 3, Image 1):

The coating is single-phase, intermetallic, composed of gamma-zinc-nickel (Ni5Zn21). At the best, a very thin and native oxide film of negligible effect, which is free from Mn, is present on the surface.

b) Heating to Approx. 750° C. (FIG. 3, Image 2)

A Zn/Mn oxide layer has formed on the coating. The coating seen metallographically is two-phase. Both gamma phases are shown, wherein in each case Fe is partially replaced by Ni and vice versa. The phases are isomorphous as regards their crystal structure.

It is characteristic that the Ni-content in the coating decreases towards the base material and similarly the Fe-content decreases towards the free surface. This form of the coating structure is present up to approx. 750° C., but can still be demonstrated in the case of very short times, less than those for through-heating of the respective blank. Typical examples for the composition of the γ-ZnNi(Fe) and the Γ-FeZn(Ni) phase of the coating are indicated in the following table:

| Phase | Fe [mass-%] | Ni [mass-%] | Zn [mass-%] |
|---|---|---|---|
| γ-ZnNi(Fe) | 3 | 14 | 83 |
| Γ-FeZn(Ni) | 16 | 6 | 78 |

c) Result of the Annealing Process (FIG. 3, Images 3, 4):

With further continued heating firstly the coating is as far as possible intermetallic, in some cases both gamma phases γ-ZnNi and r-ZnFe are present next to each other. However, in the course of the annealing process (above approx. 750° C.) an α-Fe mixed crystal, in which Zn and Ni are present in solution, forms in the coating.

With further continued heating, the Zn/Mn oxide layer continues to be present. The coating seen metallographically and radiographically is two-phase. A mixed gamma phase (γ/Γ-ZnNi(Fe)) forms. It is characteristic that this phase is quite rich in Ni. A new phase forms at the steel-coating boundary phase. An α-Fe mixed crystal, in which Zn and Ni are in solution, is present. The forced solution takes place due to the swift cooling rate. Typical examples of the composition of the coating layers are indicated in the following table:

| Phase | Fe [mass-%] | Ni [mass-%] | Zn [mass-%] |
|---|---|---|---|
| γ/Γ-ZnNi(Fe) | 7 | 13 | 80 |
| α-Fe(Zn,Ni) mixed crystal | 70 | 3 | 27 |

The finished component always has a two-phase coating, consisting of an α-Fe mixed crystal, in which Zn and Ni are present in forced solution, and a mixed gamma phase $Zn_xNi(Fe)_y$ in which Ni-atoms are replaced by Fe-atoms and vice versa.

Dependent on the point in time at which the annealing treatment is completed and on the annealing temperature, the mixed gamma phase "γ/Γ-ZnNi(Fe)" diffuses in the "α-Fe(Zn,Ni)-MK" α-Fe mixed crystal area, which now reaches to below the "ZnMn oxide" layer. This type of phase structure is promoted by:

high temperatures
long oven dwell times
minimum layer thicknesses

Typical examples of the composition of the coating layers are indicated in the following table:

| Phase | Fe [mass-%] | Ni [mass-%] | Zn [mass-%] |
|---|---|---|---|
| γ/Γ-ZnNi(Fe) | 14 | 13 | 73 |
| α-Fe(Zn,Ni) mixed crystal | 71 | 3 | 26 |

Two states of the coatings reached after completion of the annealing treatment are illustrated by way of example in FIG. 3, images 3 and 4.

Figure 4:
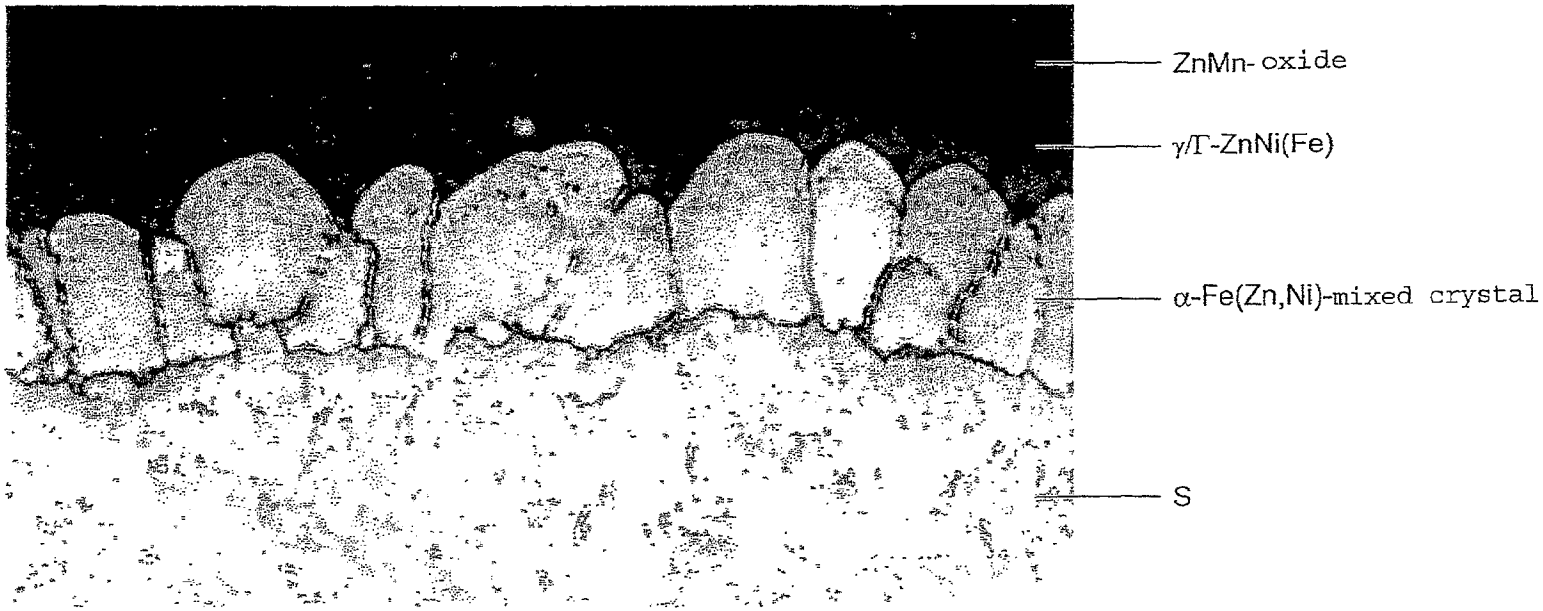
FIGS. 4, 5 are micrographs of a coating present on a component produced according to the invention.

FIG. 3, image 3 in this case shows the state of the coating which comes into being if comparably low annealing temperatures, short oven dwell times or large layer thicknesses of the coating are maintained. In FIG. 4 *a* microscopic flash-assisted photograph of a cross section of a coating produced in the inventive way is shown in this state.

Figure 5:
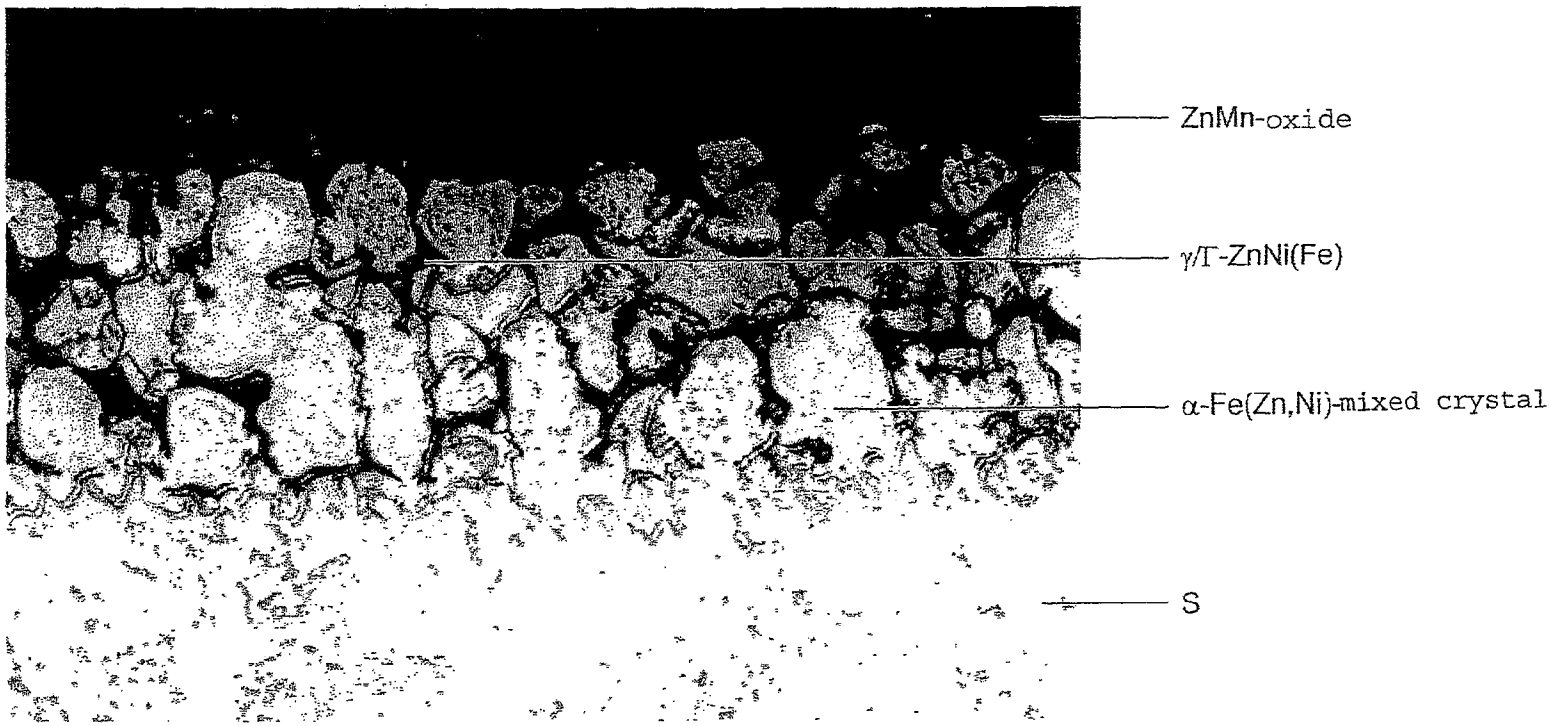

FIG. 3, image 4, however, shows a structure of the coating, which comes into being with high annealing temperatures, comparably long annealing time or minimum layer thickness of the coating. In this case the state shown in FIG. 3, image 3 as well as FIG. 4, illustrates an interim stage, which is undergone on the way to the state illustrated in FIG. 3, image 4. In FIG. 5 a microscopic flash-assisted photograph of a cross section of a coating produced in the inventive way is shown in this state.

It can be confirmed that in phase c) elucidated above (FIG. 3, images 3 and 4) the α-Fe(Zn,Ni) mixed crystal contains <30 wt.-% Zn and the mixed gamma phase γ/Γ-ZnNi(Fe) comprises >65 wt.-% Zn. Due to the high Zn content of the mixed gamma phase γ/Γ-ZnNi(Fe) an elevated anti-corrosion effect is achieved compared with pure Zn/Fe systems.

With the invention, a method by which a component provided with a well-adhering and particularly effective metallic anti-corrosion coating can be produced in a simple manner is therefore available. For this purpose, a flat steel product produced from steel containing 0.3-3% manganese and having a yield point of 150-1100 MPa as well as tensile strength of 300-1200 MPa is coated with an anti-corrosion coating, which comprises a coating of ZnNi alloy which is electrolytically deposited on the flat steel product which coating is composed in a single phase of γ-ZnNi phase and which contains, as well as zinc and unavoidable impurities 7-15 wt.-% nickel. A blank is then obtained from the flat steel product and is directly heated to at least 800° C. and is then formed into the steel component or is first formed into the steel component, which is then heated to at least 800° C. The steel component obtained in the respective cases is finally hardened by being cooled sufficiently fast for hardened microstructures to form, from a temperature at which the steel component is in a suitable state for hardened or tempered microstructures to form.

TABLE 1

| Specimen | Zn [g/l] | Ni [g/l] | Na2SO4 [g/l] | pH-value | Temp. [° C.] | Type of cell | Speed of flow [m/s] | Current density [A/dm$^2$] |
|---|---|---|---|---|---|---|---|---|
| A | 42 | 126 | 28 | 1.6 | 65 | Horizontal | 0.3 | 10 |
| B | 42 | 126 | 28 | 1.6 | 65 | Horizontal | 0.3 | 10 |
| C | 42 | 126 | 28 | 1.6 | 65 | Horizontal | 0.3 | 10 |
| D | 75 | 70 | 23 | 1.4 | 60 | Vertical | 4 | 40 |
| E | 75 | 79 | 23 | 1.4 | 60 | Vertical | 4 | 40 |
| F | 75 | 75 | 23 | 1.4 | 60 | Vertical | 4 | 40 |
| G | 75 | 85 | 23 | 1.4 | 60 | Vertical | 4 | 40 |
| H | 75 | 90 | 25 | 1.4 | 63 | Vertical | 4 | 40 |
| I | 75 | 79 | 23 | 1.4 | 60 | Horizontal | 3.5 | 40 |
| J | 105 | 75 | 23 | 1.4 | 60 | Horizontal | 4.4 | 40 |
| K | 75 | 79 | 23 | 1.4 | 60 | Horizontal | 3.5 | 40 |
| L | 42 | 126 | 28 | 1.6 | 65 | Vertical | 3.5 | 40 |
| M | 42 | 126 | 28 | 1.6 | 65 | Vertical | 3.5 | 40 |
| N | 62 | 75 | 27 | 1.6 | 65 | Horizontal | 0.5 | 20 |
| O | 62 | 75 | 27 | 1.6 | 65 | Horizontal | 0.5 | 20 |
| P | 62 | 75 | 27 | 1.6 | 65 | Horizontal | 0.5 | 20 |
| Q | 36 | 144 | 25 | 1.5 | 69 | Horizontal | 0.3 | 10 |
| V1 | 75 | 70 | 23 | 1.4 | 60 | Vertical | 4 | 40 |
| V2 | 75 | 79 | 23 | 1.4 | 60 | Vertical | 4 | 40 |
| Z | Melt dip coating - hot-dip galvanised in the conventional way | | | | | | | |

TABLE 2

| | | Coating | | | | |
|---|---|---|---|---|---|---|
| Specimen | Mn content in substrate metal [% by mass] | Thickness of Ni flash layer [μm] | Thickness of ZnNi coating [μm] | Ni content of ZnNi coating [% by mass] | Crystallographic structure of ZnNi coating | According to the invention? |
| A | 1.3 | — | 6 | 14 | γ | Yes |
| B | 1.3 | — | 8 | | γ | Yes |

TABLE 2-continued

| Specimen | Mn content in substrate metal [% by mass] | Coating: Thickness of Ni flash layer [μm] | Coating: Thickness of ZnNi coating [μm] | Coating: Ni content of ZnNi coating [% by mass] | Coating: Crystallographic structure of ZnNi coating | According to the invention? |
|---|---|---|---|---|---|---|
| C | 1.3 | — | 10 | | γ | Yes |
| D | 1 | — | 10 | 9 | γ | Yes |
| E | 2 | — | 10 | 12 | γ | Yes |
| F | 1 | — | 15 | 11 | γ | Yes |
| G | 1.4 | — | 8 | 12 | γ | Yes |
| H | 1.4 | — | 7 | 13 | γ | Yes |
| I | 1.5 | — | 5 | 10 | η + γ | No |
| J | 1.5 | — | 8 | 9 | η + γ | No |
| K | 1.5 | — | 10 | 11 | η + γ | No |
| L | 1.5 | 1 | 8 | 14 | γ | No |
| M | 1.25 | 2 | 7 | | γ | No |
| N | 1.25 | — | 6 | 13 | γ | Yes |
| O | 1.25 | — | 8 | | γ | Yes |
| P | 2.2 | — | 9 | | γ | Yes |
| Q | 1.3 | — | 8 | 16 | γ | No |
| V1 | 0.1 | — | 10 | 9 | γ | No |
| V2 | 0.2 | — | 10 | 12 | γ | No |
| Z | 1.2 | | | | η | No |

TABLE 3

| Specimen | Blank | Coating: Thickness [μm] | Coating: Ni content [% by weight] | T oven [° C.] | t anneal [min] | Behaviour when hot formed | Cracking | Corrosion of substrate metal 72 h[2)] | Corrosion of substrate metal 144 h[2)] | According to the invention |
|---|---|---|---|---|---|---|---|---|---|---|
| A | 1 | 6 | 14 | 880 | 5 | Good | No | No | Yes | Yes |
| B | 2 | 8 | | 880 | 4 | Good | No | No | Yes | Yes |
| B | 3 | 8 | | 880 | 5 | Good | No | No | Yes | Yes |
| C | 4 | 10 | | 880 | 6 | Good | No | No | Yes | Yes |
| C | 5 | 10 | | 880 | 4 | Good | No | No | Yes | Yes |
| C | 6 | 10 | | 880 | 5 | Good | No | No | Yes | Yes |
| C | 7 | 10 | | 860 | 7 | Good | No | No | Yes | Yes |
| C | 8 | 10 | | 860 | 5 | Good | No | No | Yes | Yes |
| D | 9 | 10 | 9 | 880 | 5 | Good | No | No | No | Yes |
| D | 10 | 10 | | 880 | 8 | Good | No | No | No | Yes |
| E | 11 | 10 | 12 | 880 | 5 | Good | No | No | No | Yes |
| E | 12 | 10 | | 860 | 8 | Good | No | No | No | Yes |
| F | 13 | 15 | 10.5 | 880 | 5 | Good | No | No | No | Yes |
| F | 14 | 15 | | 880 | 5 | Good | No | No | No | Yes |
| H | 15 | 7 | 13 | 880 | 5 | Good | No | No | No | Yes |
| N | 16 | 6 | | 860 | 7 | Good | No | No | No | Yes |
| N | 17 | 6 | | 880 | 6 | Good | No | No | No | Yes |
| O | 18 | 8 | | 860 | 10 | Good | No | No | No | Yes |
| O | 19 | 8 | | 880 | 8 | Good | No | No | No | Yes |
| O | 20 | 8 | | 900 | 6 | Good | No | No | No | Yes |
| P | 21 | 9 | | 860 | 12 | Good | No | No | No | Yes |
| P | 22 | 9 | | 880 | 10 | Good | No | No | No | Yes |
| P | 23 | 9 | | 900 | 8 | Good | No | No | No | Yes |
| L | 31 | (1)8[1)] | 14 | 880 | 3 | Good | No | Yes | Yes | No |
| L | 32 | (1)8[1)] | | 880 | 4 | Good | No | Yes | Yes | No |
| L | 33 | (1)8[1)] | | 880 | 5 | Good | No | Yes | Yes | No |
| M | 34 | (2)7[1)] | | 860 | 4 | Good | No | Yes | Yes | No |
| M | 35 | (2)7[1)] | | 860 | 5 | Good | No | Yes | Yes | No |
| Q | 36 | 8 | 16 | 880 | 7 | Good | No | Yes | Yes | No |
| V1 | 37 | 10 | 9 | 860 | 8 | Poor | No further assessment due to poor behaviour when hot formed (local peeling) | | | No |
| V1 | 38 | 10 | | 880 | 5 | Poor | | | | No |
| V2 | 39 | 10 | 12 | 880 | 5 | Poor | | | | No |
| V2 | 40 | 10 | | 860 | 8 | Poor | | | | No |
| Z | 41 | 10 | — | 880 | 5 | Good | Yes | No | No | No |

[1)]Values in ( ) = Thickness of Ni flash

[2)]Salt spray test under DIN EN ISO 9227

The invention claimed is:

1. A method of producing a steel component with a metallic coating which gives protection against corrosion, comprising:

a) providing a flat steel product produced from a steel material containing 0.3-3 wt. % manganese, which steel material has a yield point of 150-1100 MPa and a tensile strength of 300-1200 MPa;

b) coating the flat steel product with an anti-corrosion coating which comprises a ZnNi alloy coating comprising a single γ-ZnNi phase which is electrolytically deposited on the flat steel product and which contains, as well as zinc and unavoidable impurities, 7-15 wt. % nickel, wherein the electrolytic deposition comprises immersing the flat steel product in an electrolyte and passing an electric current through the electrolyte, a speed of the flow of the electrolyte relative to the flat steel product is 0.1-6 m/s, a Ni:Zn ratio of the electrolyte is 0.4-4, electric current is passed at a current density of 10-140 A/dm$^2$, a temperature of the electrolyte is 30-70° C., and a pH of the electrolyte is 1-3.5, c) heating a blank formed from the flat steel product to a blank temperature of at least 800° C., d) forming the steel component from the blank in a forming die, and e) hardening the steel component by cooling from a temperature at which the steel component is in a state suitable for the formation of tempered or hardened microstructure, at a cooling rate which is sufficient for the formation of the tempered or hardened microstructure.

2. A method of producing a steel component with a metallic coating which gives protection against corrosion, comprising:

a) providing a flat steel product produced from a steel material containing 0.3-3 wt. % manganese, which steel material has a yield point of 150-1100 MPa and a tensile strength of 300-1200 MPa, b) coating the flat steel product with an anti-corrosion coating which comprises a ZnNi alloy coating comprising a single γ-ZnNi phase which is electrolytically deposited on the flat steel product and which contains, as well as zinc and unavoidable impurities, 7-15 wt. % nickel, wherein the electrolytic deposition comprises immersing the flat steel product in an electrolyte and passing an electric current through the electrolyte, a speed of the flow of the electrolyte relative to the flat steel product is 0.1-6 m/s, a Ni:Zn ratio of the electrolyte is 0.4-4, electric current is passed at a current density of 10-140 A/dm$^2$, a temperature of the electrolyte is 30-70° C., and a pH of the electrolyte is 1-3.5, c) forming the steel component from a blank formed from the flat steel product in a forming die, d) heating the steel component to a component temperature of at least 800° C., e) hardening the steel component by cooling from a temperature at which the steel component is in a state suitable for the formation of tempered or hardened microstructure, at a cooling rate which is sufficient for the formation of the tempered or hardened microstructure.

3. The method according to claim 2 further comprising forming the steel component a second time after the heating of the steel component.

4. The method according to claim 1, wherein, after hardening, the coating, which gives protection against corrosion, on the steel component comprises a coating layer, at least 70 mass-% of which consists of α-Fe(Zn,Ni) mixed crystal and the remainder of intermetallic compounds of Zn, Ni and Fe.

5. The method according to claim 4, wherein the intermetallic compounds are dispersed in the α-Fe(Zn,Ni) mixed crystal.

6. The method according to claim 1, wherein, after hardening, an Mn-containing layer in which Mn is present in metallic or oxidic form is present on the anti-corrosion coating.

7. The method according to claim 6, wherein the Mn-containing layer is 0.1-5 μm thick.

8. The method according to claim 6, wherein the Mn content of the Mn-containing layer is 0.1 to 18 wt. %.

9. The method according to claim 1, wherein, before the forming of the steel component, the anti-corrosion coating comprises an additional layer of Zn which is likewise applied to the coating of ZnNi alloy before the forming of the steel component.

10. The method according to claim 9, wherein the layer of Zn is 2.5 to 12.5 μm thick.

11. The method according to claim 9, wherein after hardening, the anti-corrosion coating of the steel component comprises a Zn-rich layer lying on the nickel-containing alloy coating.

12. The method according to claim 1, wherein the forming of the steel component is performed as hot forming and wherein the forming and cooling of the steel component are performed in a single operation in a hot-forming die.

13. The method according to claim 1, wherein the forming of the steel component and the hardening are performed in succession to one another in two separate steps.

14. A method of producing a steel component with a metallic coating which gives protection against corrosion, comprising:

a) providing a flat steel product comprising:

a steel material comprising 0.3-3 wt. % manganese and having a yield point of 150-1100 MPa and a tensile strength of 300-1200 MPa; and an anti-corrosion coating comprising a ZnNi alloy coating having a single γ-ZnNi phase electrolytically deposited on the steel product and comprising, as well as zinc and unavoidable impurities, 7-15 wt. % nickel, wherein the deposition of the ZnNi alloy coating was performed by immersing the flat steel product in an electrolyte and passing an electric current through the electrolyte, a speed of the flow of the electrolyte relative to the flat steel product is 0.1-6 m/s, a Ni:Zn ratio of the electrolyte is 0.4-4, electric current is passed at a current density of 10-140 A/dm$^2$, a temperature of the electrolyte is 30-70° C., and a pH of the electrolyte is 1-3.5, b) heating a blank formed from the flat steel product to a blank temperature of at least 800° C., c) forming the steel component from the blank in a forming die, and d) hardening the steel component by cooling from a temperature at which the steel component is in a state suitable for the formation of tempered or hardened microstructure, at a cooling rate which is sufficient for the formation of the tempered or hardened microstructure.

15. A method of producing a steel component with a metallic coating which gives protection against corrosion, comprising:

a) providing a flat steel product comprising:

a steel material comprising 0.3-3 wt. % manganese and having a yield point of 150-1100 MPa and a tensile strength of 300-1200 MPa; and an anti-corrosion coating comprising a ZnNi alloy coating having a single γ-ZnNi phase electrolytically deposited on the steel product and comprising, as well as zinc and unavoidable impurities, 7-15 wt. % nickel, wherein the deposition of the ZnNi alloy coating was performed by immersing the flat steel product in an electrolyte and passing an electric current through the electrolyte, a speed of the flow of the electrolyte relative to the flat steel product is 0.1-6 m/s, a Ni:Zn ratio of the electrolyte is 0.4-4, electric current is passed at a current density of 10-140 A/dm$^2$, a temperature of the electrolyte is 30-70° C., and a pH of the electrolyte is 1-3.5, b) forming the steel component from a blank formed from the flat steel product in a forming die, c) heating the steel component to a component temperature of at least 800° C., and d) hardening the steel component by cooling from a temperature at which the steel component is in a state suitable for the formation of tempered or hardened microstructure, at a cooling rate which is sufficient for the formation of the tempered or hardened microstructure.

* * * * *